US009957715B1

(12) United States Patent
Carlson

(10) Patent No.: US 9,957,715 B1
(45) Date of Patent: May 1, 2018

(54) STRUCTURAL INSULATED PANEL FRAMING SYSTEM WITH A RADIANT BARRIER

(71) Applicant: Carl Arthur Carlson, Hailey, ID (US)

(72) Inventor: Carl Arthur Carlson, Hailey, ID (US)

( * ) Notice: Subject to any disclaimer, the term of this patent is extended or adjusted under 35 U.S.C. 154(b) by 0 days. days.

(21) Appl. No.: 15/710,497

(22) Filed: Sep. 20, 2017

(51) Int. Cl.

| | |
|---|---|
| ***E04B 1/74*** | (2006.01) |
| ***E04C 2/296*** | (2006.01) |
| *E04B 1/76* | (2006.01) |
| *E04B 1/80* | (2006.01) |

(52) U.S. Cl.
CPC ..... *E04C 2/296* (2013.01); *E04B 1/7604* (2013.01); *E04B 1/7654* (2013.01); *E04B 1/80* (2013.01); *E04B 2001/7691* (2013.01)

(58) Field of Classification Search
CPC ..... E04C 2/296; E04B 1/7604; E04B 1/7654; E04B 1/80; E04B 2001/7691
See application file for complete search history.

(56) References Cited

U.S. PATENT DOCUMENTS 3,466,831 A * 9/1969 Lenoir ..... E04C 2/292 52/394
3,535,844 A * 10/1970 Glaros ..... E04C 2/296 52/309.9
3,619,437 A * 11/1971 McDonald, Jr. ..... B29C 44/18 264/257
4,107,892 A * 8/1978 Bellem ..... E04B 1/54 52/396.04
4,367,578 A * 1/1983 Johnson ..... B23Q 7/007 29/429
4,471,591 A * 9/1984 Jamison ..... E04B 1/7604 52/404.1

(Continued)

FOREIGN PATENT DOCUMENTS

JP 2015-222004 A 12/2015
JP 2016-037791 A 3/2016

OTHER PUBLICATIONS

Kosny, Jan et al., "A Review of High R-Value Wood Framed and Composite Wood Wall Technologies Using Advanced Insulation Techniques", Energy and Buildings 72(2014) 441-456.

(Continued)

*Primary Examiner* — Paola Agudelo
(74) *Attorney, Agent, or Firm* — Morgan, Lewis & Bockius LLP

(57) ABSTRACT

A framing system is provided that comprises an exterior siding and structural frame elements. The structural frame elements are arranged against a first side of the exterior siding. The elements are evenly spaced along the exterior siding thereby creating a plurality of structural element cavities. Each cavity comprises a polyurethane foam overlaying a portion of the first side of the exterior siding bounded by the respective cavity. A radiant barrier with an emissivity of less than 0.50 is attached to the elements and includes a plurality of indented portions, each of which protrudes into a corresponding cavity thereby creating a respective first sealed air space between the corresponding foam and the radiant barrier in each structural element cavity. An interior siding covers the barrier and is attached to the elements thereby creating a respective second sealed space between the barrier and the interior siding in each structural element cavity.

30 Claims, 10 Drawing Sheets

(56) References Cited

U.S. PATENT DOCUMENTS

| | | | | |
|---|---|---|---|---|
| 5,285,609 | A * | 2/1994 | Goad | E04C 2/292 52/588.1 |
| 5,819,496 | A * | 10/1998 | Sperber | E04B 1/7604 52/404.1 |
| 7,807,232 | B2 | 10/2010 | Yiallizis et al. | |
| 7,827,743 | B2 * | 11/2010 | Campisi | E04B 1/74 52/198 |
| 8,572,900 | B1 * | 11/2013 | Potts | E02D 29/14 52/19 |
| 9,624,666 | B2 | 4/2017 | Singleton et al. | |
| 2003/0070378 | A1 * | 4/2003 | Knapp | E04B 1/767 52/483.1 |
| 2010/0325999 | A1 * | 12/2010 | Devalapura | E04B 1/7654 52/506.05 |
| 2011/0271626 | A1 * | 11/2011 | Lewis | E04B 1/7654 52/407.3 |
| 2012/0021172 | A1 * | 1/2012 | Willson | B32B 13/14 428/131 |
| 2016/0160503 | A1 * | 6/2016 | Beals | E04C 2/46 52/408 |
| 2017/0167134 | A1 * | 6/2017 | Mayer | E04B 1/7612 |

OTHER PUBLICATIONS

Straube, John et al., "Spray Polyurethane Foam: The Need for Vapor Retarders in Above-Grade Residential Walls", CUFCA Study: Vapor Barriers in Above-Grade Walls, Report by Building Engineering Group, University of Waterloo, Building Science Press, whole article (2009).

* cited by examiner

STRUCTURAL INSULATED PANEL FRAMING SYSTEM WITH A RADIANT BARRIER

TECHNICAL FIELD

The present disclosure relates generally to a structural insulation system with a radiant barrier.

BACKGROUND

Wood and steel framing in buildings is mostly used in North America, Scandinavia, and Central Europe. Of interest ever since the energy crisis in the early 1970s in the United States is improvement in the thermal performance envelope (building envelope) afforded by such structural insulated framing systems. Building envelopes play an important role in the heat transfer between the exterior and the interior spaces of a building. From a thermal perspective, a well-performing building frame system is one that contributes to thermal comfort inside the building with minimum consumption of space conditioning energy. See Barrios et al., 2012, "Envelope wall/roof thermal performance parameters for non air-conditioned buildings," Energy and Buildings 50 pp. 120-127 and ASHRAE, Energy-efficient Design of Low-rise Residential Buildings (ASHRAE Standard 90.2-2004), American Society of Heating, Refrigerating and Air-Conditioning Engineers, Inc., 1791 Tullie Circle NE, Atlanta, Ga. 30329, 2006, each of which is hereby incorporated by reference.

Building envelope technologies have been evaluated in the United States using techniques such a hot-box testing as well as numerical thermal analysis. Technical information, field and lab test thermal performance data, and three-dimensional thermal analysis from such evaluation provides for an objective evaluation of the existing building envelope technologies. For instance, R-values or U-values provide a measure of thermal performance of building envelope components. For building frame systems, the part of the frame that is traditionally analyzed is the cavity of the frame that is uninterrupted by details such as wooden or steel structural elements, windows, or vents, which comprises about 50-80% of the total area of the opaque building frame. For instance, in wall systems that make use of studs, this would be the stud cavities between studs. The remaining 20-50% of the wall area (e.g., the windows, studs, vents, etc.) is typically not analyzed when rating conventional insulation. As a result, for most forms of insulation, traditionally estimated R-values for such insulation are 20-30% higher than the corresponding overall whole wall R-values that are achieved when such insulation is used.

In principle, thermal performance of building frame assemblies has been increased conventionally by application of thicker and wider insulation space in building frame cavities, such as wall cavities, installing insulating sheathing, improving thermal resistance of insulation materials, reducing or eliminating thermal bridging, and/or applying airtight construction. Combinations of these methods is normally applied in practice to reach a high R-value and sometimes to improve other building performance aspects such as durability, constructability, and costs. For instance, Kosny et al. calculated that for wood-framed houses, 25 mm of EPS foam sheathing gives an average 7.3% of saving in that part of the whole building energy consumption which is generated by building enclosure. See, Kosny 2014, "A review of high R-value wood framed and composite wood wall technologies using advanced insulation techniques," Energy and Buildings 72, pp. 441-456, which is hereby incorporated by reference.

One conventional wall technology that has been employed in wood frame building construction is exterior insulation finish system (EIFS). EIFS utilizes rigid insulation sheathing and plaster finish on the exterior wall surface. As illustrated in FIG. 1, EIFS walls typically consist of expanded polystyrene (EPS) board attached adhesively or mechanically to the structural sheathing boards and covered with a lamina composed of a modified cement base coat with woven glass fiber reinforcement and a textured colored finish coat. Thermal performance of EIFS wall is heavily dependent on the thickness of the exterior insulation applied. For example, using 100 mm thick EPS foam board with empty 2×4 wall stud cavity yields R-value of around RSI—3.5 $m^2$ K/W. If cellulose or fiberglass insulation is added into the 2×6 wall stud cavity in addition to the 100 mm EPS foam board, the overall wall R-value of RSI—5.3 $m^2$ K/W can be obtained. See Straube et al., 2009, "U.S. DOE Building America Special Research Project: High R Walls Case Study Analysis (Research Report-0903)," Building Science Press, Massachusetts, which is hereby incorporated by reference. It should be noted however that building codes in most North American jurisdictions have limited the maximum exterior foam insulation thickness to 100 mm due to fire performance issues emerged from fuel contribution of the insulation material. A historical drawback with EIFS has been moisture performance due to poor detailing practice related to water drainage. However, EIFS walls have been further developed and upgraded to overcome this issue. In fact, field monitoring and laboratory tests results have indicated that EIFS, being one of the most tested wall assemblies, demonstrates positive performance with respect to moisture management system and thermal control. See Karagiozis, 2006, "The Hygrothermal Performance of Exterior Wall Systems: Key Points of the Oak Ridge National Laboratory NET Facilities Research Project," Report Prepared for EIMA Research Project, Oak Ridge National Laboratory, Tennessee, which is hereby incorporated by reference. After exposing these wall systems to real weather for thirty months, it was found that the best performing wall cladding was the EIFS wall with 100 mm of EPS insulation and a fluid-applied water-resistive barrier. It was also found from that study, that EIFS drainage assemblies using vertical ribbons of adhesive provide a drainage path and air space that contribute positively toward hygrothermal performance of walls. See Karagiozis, Id.

Further examples of conventional framing systems include double walls, Larsen truss walls, optimum or advanced framing walls, European walls, and walls with furring and composites. Such walls are framing systems are disclosed in Kosny 2014, "A review of high R-value wood framed and composite wood wall technologies using advanced insulation techniques," Energy and Buildings 72, pp. 441-456, which is hereby incorporated by reference.

Given ever rising energy costs, and the ever present need for affordable housing, improved framing systems that provide satisfactory R-values without compromising other performance aspects such as durability, constructability, and costs, and that are compliant with applicable building codes are needed in the art.

SUMMARY

The present disclosure addresses the above-identified shortcomings. A framing system abutting an interior space of a building is provided that comprises an exterior siding having a first side and a second side. The first side of the exterior siding faces the interior space of the building and the second side of the exterior siding opposes the first side and thus faces away from the interior space of the building. The framing system further comprises a plurality of structural frame elements (e.g., joists, studs, rafters, etc.). Each respective structural frame element in the plurality of structural frame elements comprises a first side and an opposing second side. The first side of each respective structural frame element in the plurality of structural frame elements is arranged against the first side of the exterior siding. Each respective structural frame element in the plurality of structural frame elements is spaced along the exterior siding at a common interval thereby creating a plurality of structural frame element cavities. Each respective structural frame element cavity comprises a polyurethane foam (e.g., two-part closed cell spray polyurethane foam) overlaying a portion of the first side of the exterior siding bounded by the respective structural frame element cavity.

A radiant barrier having an emissivity of 0.50 or less is attached to the second side of each respective structural frame element in the plurality of structural frame elements. The radiant barrier includes a plurality of indented portions. Each indented portion in the plurality of indented portions is indented (protrudes) into a corresponding structural frame element cavity in the plurality of structural frame element cavities, thereby creating a respective first sealed air space, in a first plurality of sealed air spaces, between the corresponding polyurethane foam and the radiant barrier in each structural frame element cavity in the plurality of structural frame element cavities.

An interior siding (e.g., wall) covers the radiant barrier and is attached to the second side of each structural frame element in the plurality of structural frame elements thereby creating a respective second sealed space, in a second plurality of sealed air spaces, between the radiant barrier and the interior siding in each structural frame element cavity in the plurality of structural frame element cavities.

In some embodiments, the polyurethane foam overlaying the portion of the first side of the exterior siding bounded by a structural frame element cavity in the plurality of structural frame element cavities is medium-density two-part closed-cell polyurethane foam insulation having a thickness of at least 38 millimeters and a long term thermal resistance (LTTR) R-value between 6.9 and 7.0 per inch.

In some embodiments, the two-part closed cell spray polyurethane foam overlaying the portion of the second side of the exterior siding bounded by a structural frame element cavity in the plurality of structural frame element cavities is medium-density two-part closed-cell spray polyurethane foam insulation having a thickness of at least 45 millimeters and a long term thermal resistance (LTTR) R-value between 5.1 and 6.8 per inch.

In some embodiments, the exterior siding comprises one or more wood panels, the interior siding comprises one or more sheetrock panels, and each structural frame element in the plurality of structural frame elements has two-inch by six-inch cross-section, is made of wood, and is at least a foot long. In some such embodiments, each structural frame element in the plurality of structural frame elements is a stud. In some such embodiments, each structural frame element in the plurality of structural frame elements is a joist.

In some embodiments, the exterior siding comprises one or more wood panels, the interior siding comprises one or more sheetrock panels, and each structural frame element in the plurality of structural frame elements has two-inch by four-inch cross-section, is made of wood, and is at least a foot long. In some such embodiments, each structural frame element in the plurality of structural frame elements is a stud. In some such embodiments, each structural frame element in the plurality of structural frame elements is a joist.

In some embodiments, the radiant barrier is stapled along a third side of a first structural frame element in the plurality of structural frame elements and a fourth side of a second structural frame element, the second structural frame element adjacent to the first structural frame element, in the plurality of structural frame elements, thereby forming a first indented portion, in the plurality of indented portions, between the first structural frame element and the second structural frame element, and the second sealed air space in the second plurality of sealed air spaces in the first indented portion has a width that is determined by an air spacing between the radiant barrier within the first indented portion and the interior siding. In some such embodiments, the air spacing is between 0.5 inches and 1.5 inches.

In some embodiments a width of each respective first sealed air space between the corresponding polyurethane foam and the radiant barrier in each structural frame element cavity in the plurality of structural frame element cavities is between 0.5 inches and 1.5 inches, and a width of each respective second sealed air space in the second plurality of sealed air spaces between the radiant barrier in each structural frame element cavity in the plurality of structural frame element cavities and the interior siding is between 0.5 inches and 1.5 inches.

In some embodiments, the framing system has a wood frame wall R-value of 13 or greater without accounting for the first plurality of sealed air spaces or the second plurality of sealed air spaces.

In some embodiments, the framing system has a wood frame wall R-value of 16 or greater without accounting for the first plurality of sealed air spaces or the second plurality of sealed air spaces.

In some embodiments, the framing system has a wood frame wall R-value of 20 or greater without accounting for the first plurality of sealed air spaces or the second plurality of sealed air spaces.

In some embodiments, the radiant barrier comprises aluminum or copper.

In some embodiments, the radiant barrier has an emissivity of less than 0.08 or less than 0.06.

In some embodiments, the polyurethane foam is two-part closed cell spray polyurethane foam and a thickness of the two-part closed cell spray polyurethane foam overlaying the portion of the first side of the exterior siding is at least 0.5 inches thick and provides an R-value of at least 5.

In some embodiments, the polyurethane foam is two-part closed cell spray polyurethane foam and a thickness of the two-part closed cell spray polyurethane foam overlaying the portion of the first side of the exterior siding is at least 0.8 inches thick and provides an R-value of at least 6.

In some embodiments, the interior siding comprises a sheet rock panel having a thickness of ½-inch (13 mm), ⅝-inch (16 mm), ¼-inch (6.4 mm), ⅜-inch (9.5 mm), ¾-inch (19.0 mm) or 1-inch (25.4 mm).

In some embodiments, the interior siding comprises a sheet rock panel having an R-value of less than 0.6.

In some embodiments, the interior siding comprises a sheet rock panel having an R-value of less than 0.6, the exterior siding comprises wall wood siding or plywood having an R-value of less than 1.0, and the framing system has a wood frame wall R-value of 13 or greater without accounting for the first plurality of sealed air spaces or the second plurality of sealed air spaces.

In some embodiments, the interior siding comprises a sheet rock panel having an R-value of less than 0.6, the exterior siding comprises wall wood siding or plywood having an R-value of less than 1.0, and the framing system has a wood frame wall R-value of 16 or greater without accounting for the first plurality of sealed air spaces or the second plurality of sealed air spaces.

In some embodiments, the first side of the exterior siding is at least 100 square feet.

In some embodiments, the interior siding is a wall or a ceiling.

BRIEF DESCRIPTION OF THE DRAWINGS

The accompanying drawings constitute a part of this specification and illustrate an embodiment of the invention and together with the specification, explain the invention.

Like reference numerals refer to corresponding parts throughout the several views of the drawings.

DETAILED DESCRIPTION

Figure 1:
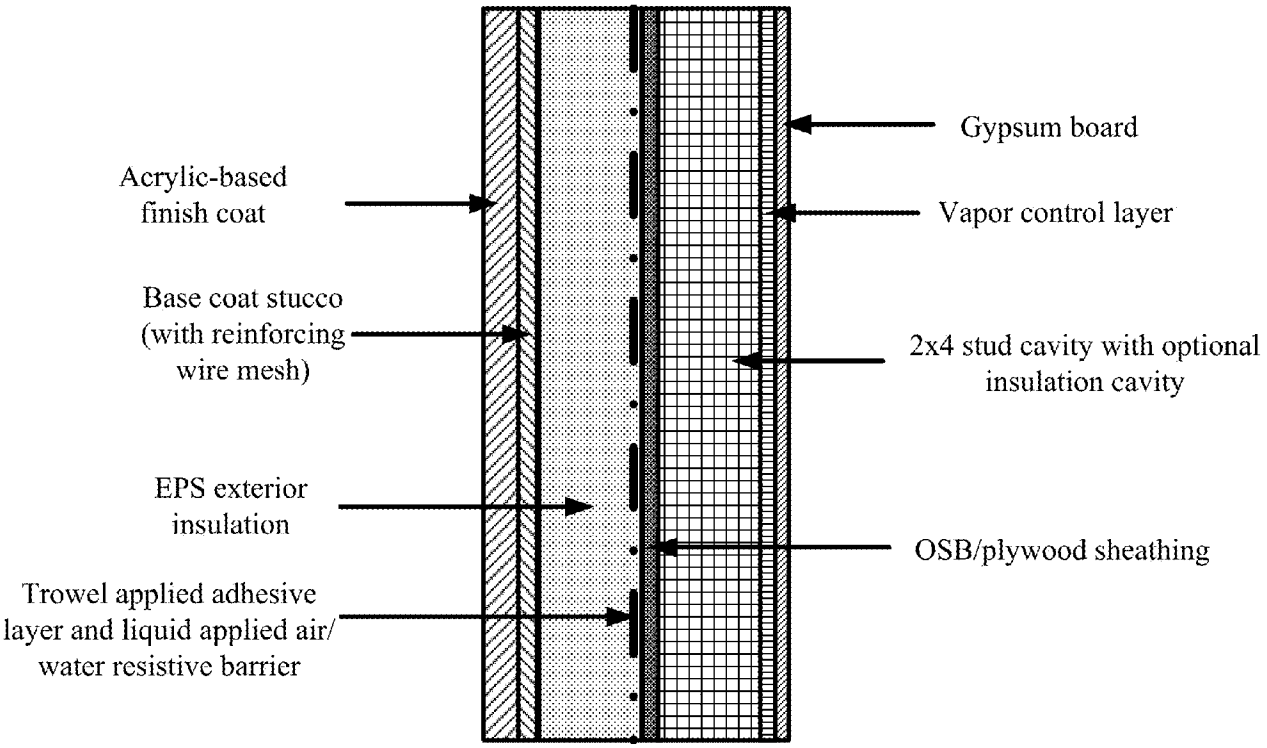
FIG. 1 (Prior Art)
FIG. 1 illustrates a typical cross section of a conventional exterior insulation finish system wall in accordance with the prior art.
Figure 2:
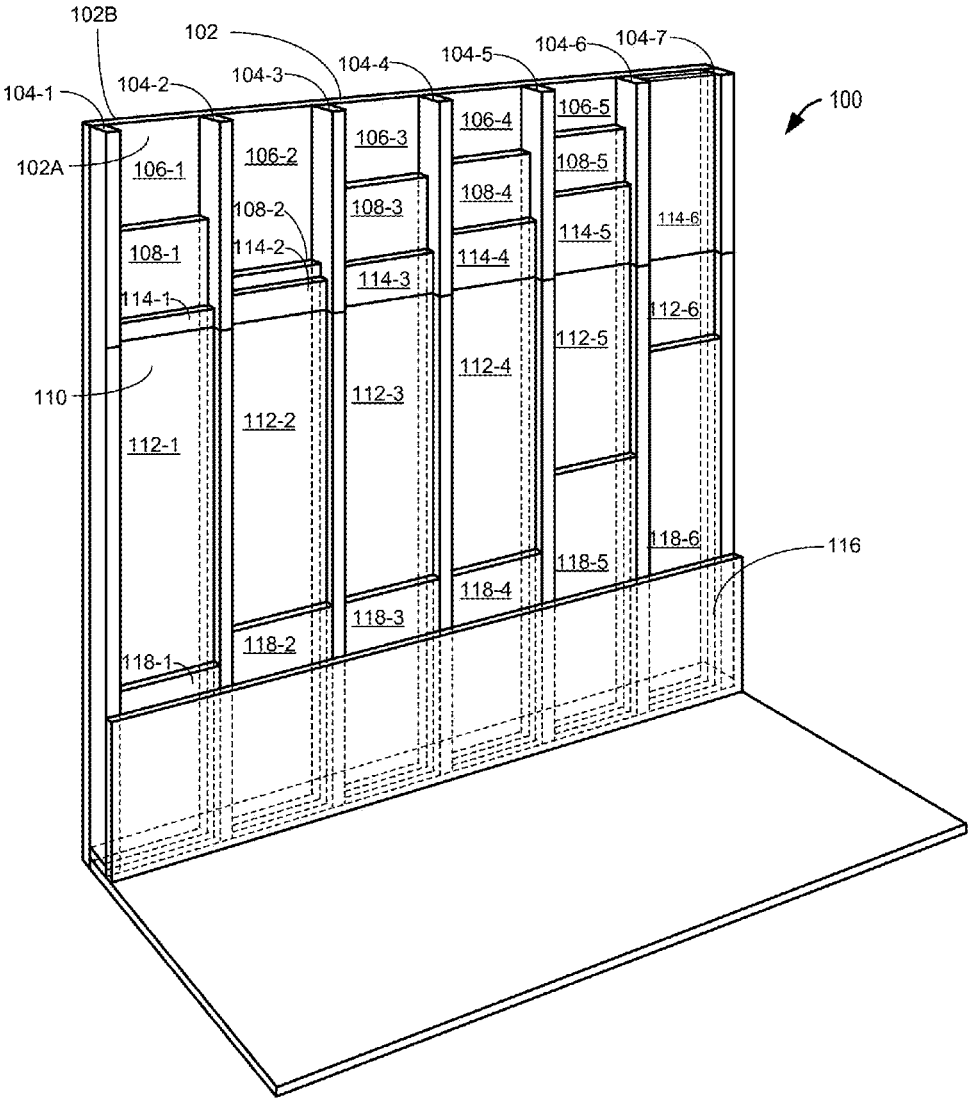
FIG. 2 illustrates a front perspective view of the material layers comprising a structural insulated panel framing system with a radiant barrier according to some embodiments.

Referring to FIG. 2, the present disclosure provides a framing system 100 that comprises an exterior siding 102 and structural frame elements 104. The structural frame elements are arranged against a first side 102A of the exterior siding. The structural frame elements are evenly spaced along the exterior siding thereby creating a plurality of structural frame element cavities. Each cavity 106 comprises a polyurethane foam 108 overlaying a portion of the first side 102A of the exterior siding bounded by the respective cavity. A radiant barrier 110 with an emissivity of less than 0.50 is attached to the structural frame elements and includes a plurality of indented portions 112, each of which is indented into a corresponding structural frame element cavity thereby creating a respective first sealed air space 114 between the corresponding foam and the radiant barrier in each structural frame element cavity. An interior siding 116 covers the barrier and is attached to the structural frame elements thereby creating a respective second sealed space 118 between the radiant barrier 110 and the interior siding 116 in each structural frame element cavity 106.

Reference will now be made in detail to embodiments, examples of which are illustrated in the accompanying drawings. In the following detailed description, numerous specific details are set forth in order to provide a thorough understanding of the present disclosure. However, it will be apparent to one of ordinary skill in the art that the present disclosure may be practiced without these specific details. In other instances, well-known methods, procedures, components, circuits, and networks have not been described in detail so as not to unnecessarily obscure aspects of the embodiments.

The present disclosure addresses the above-identified shortcomings. Referring to FIG. 2, a framing system 100 that abuts an interior space of the building is provided that comprises an exterior siding 102 having a first side 102A and a second side 102B. The first side 102A faces the interior space and the opposing second side 102B faces away from the interior space.

In some embodiments, the exterior siding 102 comprises plywood sheathing, oriented strand board (OSB), or wood-based panel. In some embodiments, the exterior siding comprises "Nail Base."

In some embodiments the exterior siding 102 includes V-groove, channel groove, or deep groove surface treatment.

In some embodiments, the exterior siding 102 comprises plywood that is manufactured under the Voluntary Product Standard PS 1-09 for structural plywood. In some embodiments, the exterior siding 102 comprises plywood or OSB that is manufactured under the provisions of APA PRP-108, Performance Standards and Qualifications Policy for Structural-Use Panels, or under the Voluntary Product Standard PS 2-10, Performance Standard for Wood-Based Structural-Use Panels.

In some embodiments the exterior siding 102 comprises a wood structural panel having a thickness of 15/32 of an inch. In some embodiments the exterior siding 102 comprises 15/32 inch structural 1 plywood having at least 4 plies and 3 layers. In some embodiments the exterior siding 102 comprises plywood having at least 4 plies and 3 layers. In some embodiments the exterior siding 102 comprises plywood having 5 plies and 5 layers. In some embodiments, the exterior siding 102 is Douglas Fir-Larch wood, Hem Fir wood, or Redwood open grain. In some embodiments the exterior siding 102 has a shear of between 270 and 680 lbs./ft., or between 270 and 440 lbs./ft. In some embodiments, the exterior siding 102 comprises oriented strand board.

In some embodiments, the exterior siding 102 is rated for exterior siding. In some such embodiments, the exterior siding has a performance rating of 11/32, 3/8, 7/16, 15/32, 1/2, 19/32, or 5/8. As used herein the term "performance rating" is a panel designation related to the panel thickness range that is linked to the nominal panel thickness designations used in the International Building Code (IBC) and International Residential Code (IRC).

In some embodiments, the exterior siding 102 is rated for wall sheathing. In some such embodiments, the exterior siding has a performance rating of 3/8, 7/16, or 15/32.

In some embodiments, the exterior siding 102 has a bond rating of Exposure 1. In some embodiments, the exterior siding 102 has a bond rating of Exterior. Bond classification relates to moisture resistance of the glue bond, and thus to the structural integrity of the panel. Exterior siding 102 has bonds capable of withstanding repeated wetting and redrying or long-term exposure to weather or other conditions of similar severity, provided they are properly finished and maintained.

In some embodiments exterior insulation is overlaid on the second side 102B of the exterior siding. In some embodiments the exterior insulation comprises building paper or other form of weather-resistant barrier. In some embodiments the exterior insulation comprises building paper or other form of weather-resistant barrier overlaid with siding panels. In some such embodiments, these siding panels have a maximum width of twelve inches. In some embodiments the exterior insulation comprises building paper or other form of weather-resistant barrier, overlaid with an air space followed by brick veneer masonry.

In some embodiments, the second side 102B of the exterior siding 102 is at least 50 square feet, at least 100 square feet, at least 200 square feet or at least 300 square feet. In some embodiments the framing system 100 has overall dimensions of at least two feet by two feet, at least four feet by four feet, at least six feet by six feet, or at least seven feet by seven feet.

In some embodiments, the exterior 102 siding comprises plywood sheathing. In some such embodiments, a trowel applied adhesive layer and liquid applied air/water resistive barrier are overlaid on the first side of the exterior siding, an exterior insulation is overlaid on the trowel applied adhesive layer, a base coat stucco with reinforcing wire mesh is overlaid the exterior insulation, and an acrylic-based finish coat is overlaid on the base coat stucco.

The framing system further comprises a plurality of structural frame elements. In some embodiments each structural frame element is made of wood. In some embodiments each structural frame element has a two-inch by four-inch cross-section and is made of a wood beam. In some embodiments each structural frame element has a two-inch by six-inch cross-section and is made of wood. In some embodiments, each structural frame element is a beam, joist, rafter, or component of a truss.

Figure 3:
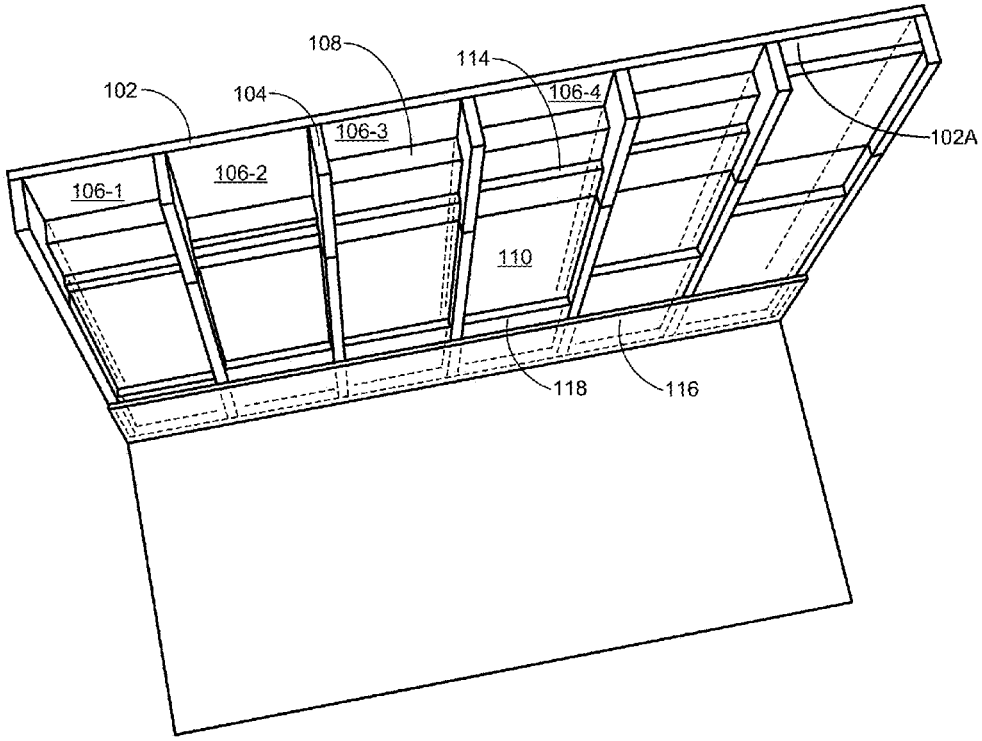
FIG. 3 illustrates a top perspective view of the material layers comprising a structural insulated panel framing system with a radiant barrier according to some embodiments.
Figure 4:
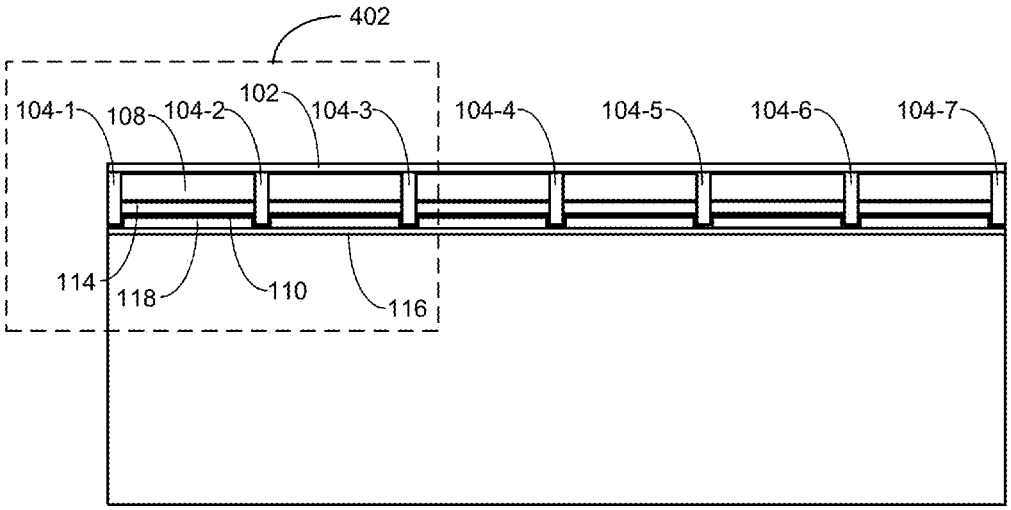
FIG. 4 illustrates a top view of the material layers comprising a structural insulated panel framing system with a radiant barrier according to some embodiments.

Each respective structural frame element 104 in the plurality of structural frame elements comprises a first side and an opposing second side. The first side of each respective structural frame element in the plurality of structural frame elements is arranged against (abuts) the first side 102A of the exterior siding 102 as illustrated in FIGS. 2, 3, and 4.

Each respective structural frame element 104 in the plurality of structural frame elements is spaced along the exterior siding at a common interval thereby creating a plurality of structural frame element cavities. In some embodiments, each structural frame element in the plurality of structural frame elements is arranged along the exterior siding at an interval of sixteen inches from the center of one structural frame element to the center of the next structural frame element. In some embodiments, each structural frame element in the plurality of structural frame elements is arranged along the exterior siding at an interval of 24 inches from the center of one structural frame element to the center of the next structural frame element.

Each respective structural frame element cavity 106 comprises a polyurethane foam 108 overlaying a portion of the first side 102A of the exterior siding 102 bounded by the respective structural frame element cavity 106.

In some embodiments, the exterior siding 102 comprises "Nail Base." Nail Base is a bonded combination of plywood and foam panel that can be used as a continuous insulating "CI" exterior. In some such embodiments, the polyurethane foam 108 is overlayed against the interior foam portion of the nail base for this assembly. In some embodiments, the Nail Base is closed-cell polyisocyanurate (polyiso) insulation board bonded to a minimum 7/16" APA/TECO rated OSB or minimum 19/32" CDX plywood on the top face. In some embodiments the exterior siding 102 is Nail Base has a long-term thermal resistance (LTTR) value between 6.3 and 24.2. In some embodiments, exterior siding is Nail Base with a nominal thickness of 1.5" to 4.5." In some embodiments, exterior siding is Nail Base manufactured in accordance with ASTM C1289, Type V. One source of Nail Base is Atlas Roofing Corporation. See the Internet at roof.atlasrwi.com/products/acfoam-nailable-polyiso-roof-insulation/acfoam-nail-base/, which is hereby incorporated by reference.

In some embodiments polyurethane film is a rigid polyurethane film. A comprehensive overview of the production of rigid polyurethane foams and their use as outer or core layer in composite elements and also their application as insulating layer in cooling or heating technology is provided in "Polyurethane," Kunststoff-Handbuch, volume 7, 3rd edition, 1993, edited by Dr. Gunter Oertel, Carl-Hanser-Verlag, MunichNienna, which is hereby incorporated by reference. In some embodiments, the polyurethane foam 108 is obtained by reacting organic polyisocyanates with one or more compounds having two or more reactive hydrogen atoms in the presence of blowing agents, catalysts and optionally auxiliaries and/or additives. For instance, in some embodiments the polyurethane foam 108 is a rigid polyrurethane foam obtainable by reaction of A) organic or modified organic polyisocyanates or mixtures thereof, B) compounds having two or more isocyanate-reactive hydrogen atoms in the presence of C) optionally further polyester polyols, D) optionally polyetherol polyols, E) optionally flame retardants, F) one or more blowing agents, G) catalysts, and H) optionally further auxiliaries and/or additives, where component B) comprises the reaction product of a1) 15 to 40 wt % of one or more polyols or polyamines having an average functionality of 2.5 to 8, a2) 2 to 30 wt % of one or more fatty acids and/or fatty acid monoesters, a3) 35 to 70 wt % of one or more alkylene oxides of 2 to 4 carbon atoms as disclosed in United States Patent Publication No. 2013/0231410, which is hereby incorporated by reference. In some embodiments, the polyurethane foam is a rigid polyurethane foam comprising the reaction product of: (A) an isocyanate reactive component comprising; (i) an aromatic polyester polyol; (ii) a rigid polyol; and (iii) an aliphatic polyester polyol, where the aliphatic polyester polyol is present in the isocyanate reactive component in an amount of from 2 to 10 parts by weight, based on 100 parts by weight of the total weight of the polyols present in the isocyanate reactive component, and (B) an isocyanate; in the presence of (C) a blowing agent. In some such embodiments, the rigid polyurethane foam has a tensile adhesion of greater than 35 kPa (5 psi) when disposed on a metal substrate, a polyester coated metal substrate, a polyurethane coated metal substrate, or an epoxy coated metal substrate, each having a substrate temperature of greater than 41° C. and tested in accordance with ASTM D1623-09 as disclosed in United States Patent Publication No. 2014/0179812, which is hereby incorporated by reference.

In some embodiments, rather than using a polyurethane foam, a foam made of polystyrene, styrene based-copolymers, polyethylene, polypropylene, polyesters, polyvinylchloride, cellulose acetate, glass beads, fumed silica, graphite, or combinations thereof is used. In some embodiments, rather than using a polyurethane foam, a foam made of polyurethane with some combination of polystyrene, styrene based-copolymers, polyethylene, polypropylene, polyesters, polyvinylchloride, cellulose acetate, glass beads, fumed silica, or graphite is used.

In some embodiments, the polyurethane foam 108 is a foam disclosed in United States Patent Publication Nos. 2017/0044301, 2017/0037637, 2017/0037615/2016/0362519, 2016/0355658, 2015/0322196, 2015/0299374, 2015/0299373, 2015/0218303, 2015/0210035; 2015/0141543; 2015/0141542; 2015/0076400; 2015/0051301; 2014/0370267; 2015/0290834; 2014/0288204, each of which is hereby incorporated by reference.

In some embodiments, the polyurethane foam 108 is a polyurethane foam manufactured and offered for sale by BASF, BAYER, DOW CHEMICAL, CERTAINTEED (See, the Internet, at certainteed.com/insulation/benefits-spray-polyurethane-foam-commercial-applications/), JOHNS MANVILLE (See, the Internet at jm.com/en/manufacturers-solutions/fibers/assembled-roving/polyurethane/, DEMILEC (See, the Internet at demilec.com/), or SWD (See, the Internet at swdurethane.com/company/).

In some embodiments, the polyurethane foam 108 is two-part closed cell spray polyurethane foam. In some embodiments, the foam 108 is created and applied on-site into the structural frame element cavities to form the foam 108 illustrated in FIGS. 2, 3, and 4 from a two-component liquid that mixes as it is being sprayed from a pressurized gun. The two liquids react chemically, bubbles form, the product expands, and the liquid is transformed into cellular plastic. The advantage of the on-site application process is that the liquid foam enters cracks, gaps and irregular cavities and fills them up as it expands. Once it cures, the foam creates a seamless, semi-rigid thermal and air barrier layer. In some embodiments, the foam 108 is a high-density 32 kg/m' (2 pcf) two-part closed cell rigid spray polyurethane foam.

In some embodiments, the foam 108 is a two-part closed-cell (about 2 pounds per cubic foot density or more) spray polyurethane foam applied in thicknesses of over two inches (50 millimeters).

In some embodiments, the foam 108 is a two-part closed-cell spray polyurethane foam that has a thermal conductivity of 0.030 W/m K or less once applied onto the first side 102A of the exterior siding 102.

In some embodiments, the foam 108 is a two-part closed-cell polyurethane spray foam that has a thermal conductivity of about 0.24 W/m K or less once applied onto the first side 102A of the exterior siding 102.

In some embodiments, the foam 108 is a two-part closed-cell polyurethane spray foam that has an insulating value (long term design value) of at least 0.9 per 25.4 mm R 6.0 per inch once applied onto the first side 102A of the exterior siding 102. In some embodiments, the foam 108 is a two-part closed-cell polyurethane spray foam that has an insulating value (long term design value) of at least 1.0 per 25.4 mm R 6.0 per inch once applied onto the first side 102A of the exterior siding 102.

In some embodiments, the foam 108 is a two-part closed-cell polyurethane spray foam that has a vapor permeability of less than 5 ng/Pa·s·m, less than 4 ng/Pa·s·m, less than 3 ng/Pa·s·m, less than 2 ng/Pa·s·m, or less than 1.5 ng/Pa·s·m once applied onto the first side 102A of the exterior siding 102.

In some embodiments, the foam 108 is a two-part closed-cell polyurethane spray foam that has a vapor permeance of less than 50 ng/Pa·s·m$^2$, less than 40 ng/Pa·s·m$^2$, less than 30 ng/Pa·s·m$^2$ or less than 20 ng/Pa·s·m$^2$ once applied onto the first side 102A of the exterior siding 102.

In some embodiments, the foam 108 is medium-density two-part closed-cell polyurethane foam insulation having a thickness of at least 38 millimeters and a long term thermal resistance (LTTR) R-value between 6.9 and 7.0 per inch. In some embodiments, the foam 108 is medium-density two-part closed-cell polyurethane foam insulation having a thickness of at least 45 millimeters and a long term thermal resistance (LTTR) R-value between 5.1 and 6.8 per inch. The R-value is a measure of thermal resistance, or ability of heat to transfer from hot to cold, through a material (such as foam 108) or an assembly of materials (such as the framing system 100). The higher the R-value, the more a material prevents heat transfer. R-value depends on the resistance of the material to heat conduction, as well as the thickness. R varies with temperature but in construction it is common to treat it as being constant for a given material (or assembly). It is closely related to the thermal transmittance (U-value) of a material or assembly, and can be simply added for materials and assemblies that are arranged in layers, or scaled proportionately if the thickness of a material changes. R-values expressed in United States customary units are about 5.67 times larger than those expressed in metric (SI) units. R is expressed as the thickness of the material normalized to the thermal conductivity, and under uniform conditions it is the ratio of the temperature difference across an insulator and the heat flux density (heat transfer per unit time per unit area, $\dot{Q}_A$) through it or $R=\Delta T/\dot{Q}_A$.

In some embodiments, a thickness of the foam 108 overlaying the portion of the first side 102A of the exterior siding 102 is at least 0.5 inches thick. In some embodiments, the foam 108 provides an R-value of at least 5. In some embodiments, the foam 108 provides an R-value of at least 6.

In some embodiments, the foam is a two-part closed cell spray polyurethane foam and the thickness of the foam in overlaying the portion of the first side 102A of the exterior siding 102 is at least 0.8 inches thick and provides an R-value of at least 6.

In some embodiments, the foam is two-part closed cell spray polyurethane foam 108 and the thickness of the foam overlaying the portion of the first side 102A of the exterior siding 102 is at least 0.8 inches thick.

In some embodiments, the foam is a two-part closed cell spray polyurethane foam 108 having a permeance of one perm or less as measured under ASTM E96. A perm is a measure of resistance to the transmission of water vapor and is equal to the number of grains of water vapor (7000 grains=1 lb.) that passes through 1 square feet of the material in 1 hour when the vapor pressure differential between two sides of the material equals 1 inch of mercury pressure (0.49 psi).

In some embodiments, the foam 108 is a two-part closed cell spray polyurethane foam overlayed on the portion of the exterior siding and has a density of at least 1.5 pounds per cubic foot, at least 1.6 pounds per cubic foot, at least 1.7 pounds per cubic foot, at least 1.8 pounds per cubic foot or at least 1.9 pounds per cubic foot.

In some embodiments, the radiant barrier 110 having an emissivity of 0.50 or less is attached to the second side of each respective structural frame element 104 in the plurality of structural frame elements as illustrated in FIGS. 2, 3, 4, and 5. In some embodiments, the radiant barrier 110 comprises aluminum or copper. In some embodiments, the radiant barrier 110 has an emissivity of less than 0.08 or less than 0.06.

In some embodiments, the radiant barrier 110 is pretreated polymer web infused with condensed small particle (nano) aluminum vapor with clear-seal corrosion protection. In some embodiments, copper is used instead of aluminum to manufacture the radiant barrier. In some embodiments, the radiant barrier 110 is formed by depositing a metallic layer on a continuous basis over a web in a vacuum chamber. For instance, in some such embodiments, the metallic layer is deposited on the web as the web is spooled through a vacuum chamber at a defined rate of speed between a feed roller and a take-up roller over a cold rotating drum.

In some embodiments, the web is a polymeric web, such as a polyester [e.g. PET, polyethylene terphalate), polypropylene (PP) or polyethylene (PE)] film. In some embodiments, a metal-evaporation unit is used to evaporate and deposit a metallic layer over the web. In some embodiments, the speed of the rotating drum is controlled to produce the desired layer thickness. In some embodiments, a conventional pre-treatment plasma unit is used prior to the metallization step to clean the web surface and promote adherence of the metal layer to the web. In some embodiments, an additional plasma unit is operated with a gas containing an oxygen-bearing component to passivate the metal layer. In this way, by using a controlled amount of oxygen or, preferably, a plasma gas containing an oxygen-bearing constituent with conventional plasma gases will produce inline oxidation of the metallic layer as necessary to prevent the subsequent formation of hydrated aluminum oxides. The effect of the treatment prevents peel-off and blocking and also provides long-term resistance to deterioration produced by moisture and other environmental factors. In some embodiments, the plasma unit (which in some embodiments consists of a low-voltage plasma treater and a source of oxygen-bearing gas mixed with conventional plasma gases such as argon, helium or nitrogen) is added to the process stream in the vacuum chamber. The plasma treater is positioned past the metal-vaporization unit to treat the metallic layer deposited over the underlying polymer web. As described, the oxygen-bearing gases in the plasma gas result in the passivation of the metal layer in a continuous inline sequence of operation. Although less preferred, in some embodiments oxygen alone is used and this provides a significant degree of passivation.

In some embodiments, the radiant barrier 110 is manufactured and/or has the properties disclosed in U.S. Pat. No. 7,807,232, which is hereby incorporated by reference.

In some embodiments, the metal is layered on both sides of the fabric. In some embodiments, the metal is layered only on one side of the fabric. In embodiments where the metal is layered only on one side of the fabric, the metal side of the fabric faces either the interior siding 116 and thus towards an interior space of the building when installed or away from the interior siding 116 and thus facing away from the interior space of the building in accordance with the present disclosure. For instance, in hot climates, such as Arizona, it is more often than not desirable to keep heat out of the interior space of the building. In such embodiments where the radiant barrier has a single metal face, the metal side of the fabric is installed away from the interior siding 116 and thus facing away from the interior space of the building. In this way, the radiant barrier 110 acts to keep heat out of the interior space of the building. By contrast, in cold climates, such as Canada, it is more often than not desirable to keep heat in the interior space of the building. In such embodiments where the radiant barrier has a single metal face, the metal side of the fabric is installed facing the interior siding 116 and thus facing toward the interior space of the building. In this way, the radiant barrier 110 acts to keep heat in the interior space of the building. Advantageously, in embodiments where the radiant barrier 110 is metal coated on both sides, the radiant barrier 110 acts to keep out heat from the interior space of the building on hot days and to keep heat in the interior space of the building on cold days.

In some embodiments, the radiant barrier 110 reflects more than 95% of the infrared or radiant heat that strikes one side of it, and does not emit over 5% of infrared or radiant heat through it. In some embodiments, the radiant barrier 110 reflects more than 90% of the infrared or radiant heat that strikes one side of it, and does not emit over 10% of infrared or radiant heat through it. In some embodiments the radiant barrier 110 is a 3100 Series Radiant Barrier, a PoliFoil Low-E film or fabric, or an IrWRAP low-E membrane available from Sigma Technologies. See the Internet at sigma-technologies.com/3100-series-rb-quality/.

In some embodiments, one side of the radiant barrier 110 is at least 95% reflective and less than 5% emissive when tested to ASTM C1371. In some embodiments, both sides of the radiant barrier 110 is at least 95% reflective and less than 5% emissive when tested to ASTM C1371. In some embodiments, the radiant barrier 110 does not exhibit delamination or bleeding when tested to ASTM C1313. In some embodiments, the radiant barrier 110 exhibits no loss of reflective surface when tested to ASTM D3310. In some embodiments, the radiant barrier 110 does not exhibit growth of fungi or mildew when tested to ASTM C1338. In some embodiments, the radiant barrier 110 exhibits at least 6.9 Perms of Water Vapor Transmission when tested to ASTM E96. In some embodiments, the radiant barrier has 0 Flame Spread and 10 Smoke when tested to ASTM E84 with ASTM E2599. In some embodiments, the radiant barrier 110 exhibits at least 46.8 MD and 27.4 CD Trapezoidal Tear Strength when tested to ASTM D4533.

In some alternative embodiments, the radiant barrier 110 is a laminate.

As illustrated in the Figures, the radiant barrier 110 is adapted to include a plurality of indented portions. Each respective indented portion 112 in the plurality of indented portions is indented into a corresponding structural frame element cavity 106 in the plurality of structural frame element cavities, thereby creating a respective first sealed air space 114, in a first plurality of sealed air spaces, between the corresponding polyurethane foam 108 and the radiant barrier 110 in each structural frame element cavity 106 in the plurality of structural frame element cavities. In some embodiments, the radiant barrier 110 is stapled along a third side of a first structural frame element and a fourth side of a second structural frame element, the second structural frame element adjacent to the first structural frame element, in the plurality of structural frame elements, thereby forming a first indented portion 112, in the plurality of indented portions, between the first structural frame element and the second structural frame element, and the second sealed air space 118 in the second plurality of sealed air spaces in the first indented portion has a width that is determined by an air spacing between the radiant barrier 110 within the first indented portion and the interior siding 116. In some such embodiments, the air spacing is between 0.5 inches and 1.5 inches.

An interior siding 116 covers the radiant barrier 110 and is attached to the second side of each structural frame element 104 in the plurality of structural frame elements thereby creating a respective second sealed space 118, in a second plurality of sealed air spaces, between the radiant barrier 110 and the interior siding 116 in each structural frame element cavity 106 in the plurality of structural frame element cavities. In some embodiments, the interior siding 116 comprises a sheet rock panel having a thickness of ½-inch (13 mm), ⅝-inch (16 mm), ¼-inch (6.4 mm), ⅜-inch (9.5 mm), ¾-inch (19.0 mm) or 1-inch (25.4 mm). In some embodiments, the interior siding 116 comprises a sheet rock panel having an R-value of less than 0.6

In some embodiments, the exterior siding 102 comprises one or more wood panels, the interior siding 116 comprises one or more sheetrock panels, and each structural frame element 104 in the plurality of structural frame elements has a two-inch by four-inch cross section and is at least a foot long. In some such embodiments, each respective structural frame element in the plurality of structural frame elements is a joist, stud, or rafters. In some such embodiments, each respective structural frame element in the plurality of structural frame elements is a component of a truss.

Figure 5:
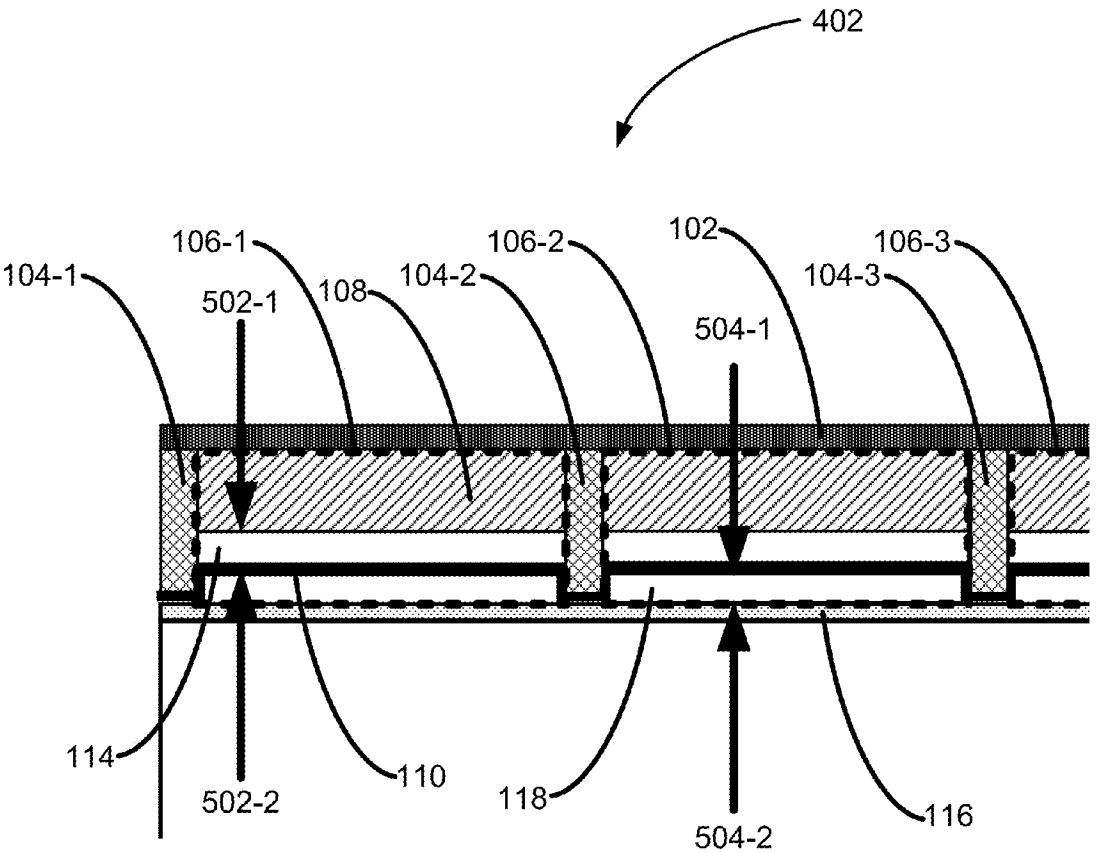
FIG. 5 is a cutaway of the top view of FIG. 4, according to some embodiments.

In some embodiments, the exterior siding 102 comprises one or more wood panels, the interior siding 116 comprises one or more sheetrock panels, and each structural frame element 104 in the plurality of structural frame elements has a two-inch by six-inch cross section and is at least a foot long. In some such embodiments, each respective structural frame element in the plurality of structural frame elements is a joist, stud, or rafters. In some such embodiments, each respective structural frame element in the plurality of structural frame elements is a component of a truss With reference to FIG. 5, which is a cutaway view of region 402 of FIG. 4 in which the foam 108, structural frame elements 104, interior siding 116, and exterior siding 102 have been respectively hashed and the structural frame element cavities 106 have been delineated with dashed boxes for clarity, in some embodiments a width (502-1-502-2) of each respective first sealed air space 114 between the corresponding foam 108 and the radiant barrier 110 in each structural frame element cavity 106 in the plurality of structural frame element cavities is between 0.5 inches and 1.5 inches. In some embodiments, the width (502-1-502-2) of each respective first sealed air space 114 between the corresponding foam 108 and the radiant barrier 110 in each structural frame element cavity 106 in the plurality of structural frame element cavities is between 1 centimeter and 25 centimeters, between 2 centimeters and 50 centimeters, or between 3 centimeters and 30 centimeters. With further reference to FIG. 5, in some embodiments a width (504-1-504-2) of each respective second sealed air space 118 in the second plurality of sealed air spaces between the radiant barrier 110 in each structural frame element cavity 106 in the plurality of structural frame element cavities and the interior siding 116 is between 0.5 inches and 1.5 inches. In some embodiments, the width (504-1-504-2) of each respective second sealed air space 118 in the second plurality of sealed air spaces between the radiant barrier 110 in each structural frame element cavity 106 in the plurality of structural frame element cavities and the interior siding 116 is between 1 centimeter and 25 centimeters, between 2 centimeters and 50 centimeters, or between 3 centimeters and 30 centimeters.

In some embodiments, the framing system 100 has a wood frame wall R-value of 13 or greater without accounting for the first plurality of sealed air spaces or the second plurality of sealed air spaces. In some embodiments, the framing system 100 has a wood frame wall R-value of 13 or greater.

In some embodiments, the framing system 100 has a wood frame wall R-value of 16 or greater without accounting for the first plurality of sealed air spaces or the second plurality of sealed air spaces. In some embodiments, the framing system 100 has a wood frame wall R-value of 16 or greater.

In some embodiments, the framing system 100 has a wood frame wall R-value of 20 or greater without accounting for the first plurality of sealed air spaces or the second plurality of sealed air spaces. In some embodiments, the framing system 100 has a wood frame wall R-value of 20 or greater.

In some embodiments, the interior siding 116 comprises a sheet rock panel having an R-value of less than 0.6, the exterior siding 102 comprises wood siding or plywood having an R-value of less than 1.0, and the framing system 100 has a wood frame wall R-value of 13 or greater without accounting for the first plurality of sealed air spaces or the second plurality of sealed air spaces. In some embodiments, the interior siding 116 comprises a sheet rock panel having an R-value of less than 0.6, the exterior siding 102 comprises wood siding or plywood having an R-value of less than 1.0, and the framing system 100 has a wood frame wall R-value of 13 or greater.

In some embodiments, the interior siding 116 comprises a sheet rock panel having an R-value of less than 0.6, the exterior siding 102 is wood siding or plywood having an R-value of less than 1.0, and the framing system 100 has a wood frame wall R-value of 16 or greater without accounting for the first plurality of sealed air spaces or the second plurality of sealed air spaces. In some embodiments, the interior siding 116 comprises a sheet rock panel having an R-value of less than 0.6, the exterior siding 102 is wood siding or plywood having an R-value of less than 1.0, and the framing system 100 has a wood frame wall R-value of 16 or greater.

Embodiments in which the framing system is part of a wall (e.g., each of the structural elements is a stud) have been disclosed. However, the framing system can be used in other parts of a building. For example, in some embodiments, referring to FIG. 6, each respective structural frame element in the plurality of structural frame elements is a joist 602 rather than a stud 604. Thus, in FIG. 6, in the case where the framing system is part of the ceiling, the exterior siding having a first side facing the interior space and an opposing second side facing away from the interior space is not shown but would rest on top of joists 602. Thus, the plurality of structural frame elements, where the structural frame elements in the plurality of structural frame elements are arranged in parallel to each other are the joists 602, with each respective structural frame element in the plurality of structural frame elements comprising a first side (facing in direction 606) and an opposing second side (facing in direction 608). The first side of each respective structural frame element in the plurality of structural frame elements abuts the first side of the exterior siding (not shown in FIG. 6). Each respective structural frame element in the plurality of structural frame elements is spaced along the exterior siding at a common interval thereby creating a plurality of structural frame element cavities 610. Each respective structural frame element cavity comprises a polyurethane foam overlaying a portion of the first side of the exterior siding bounded by the respective structural frame element cavity (not shown in FIG. 6). A radiant barrier (not shown in FIG.

Figure 6:
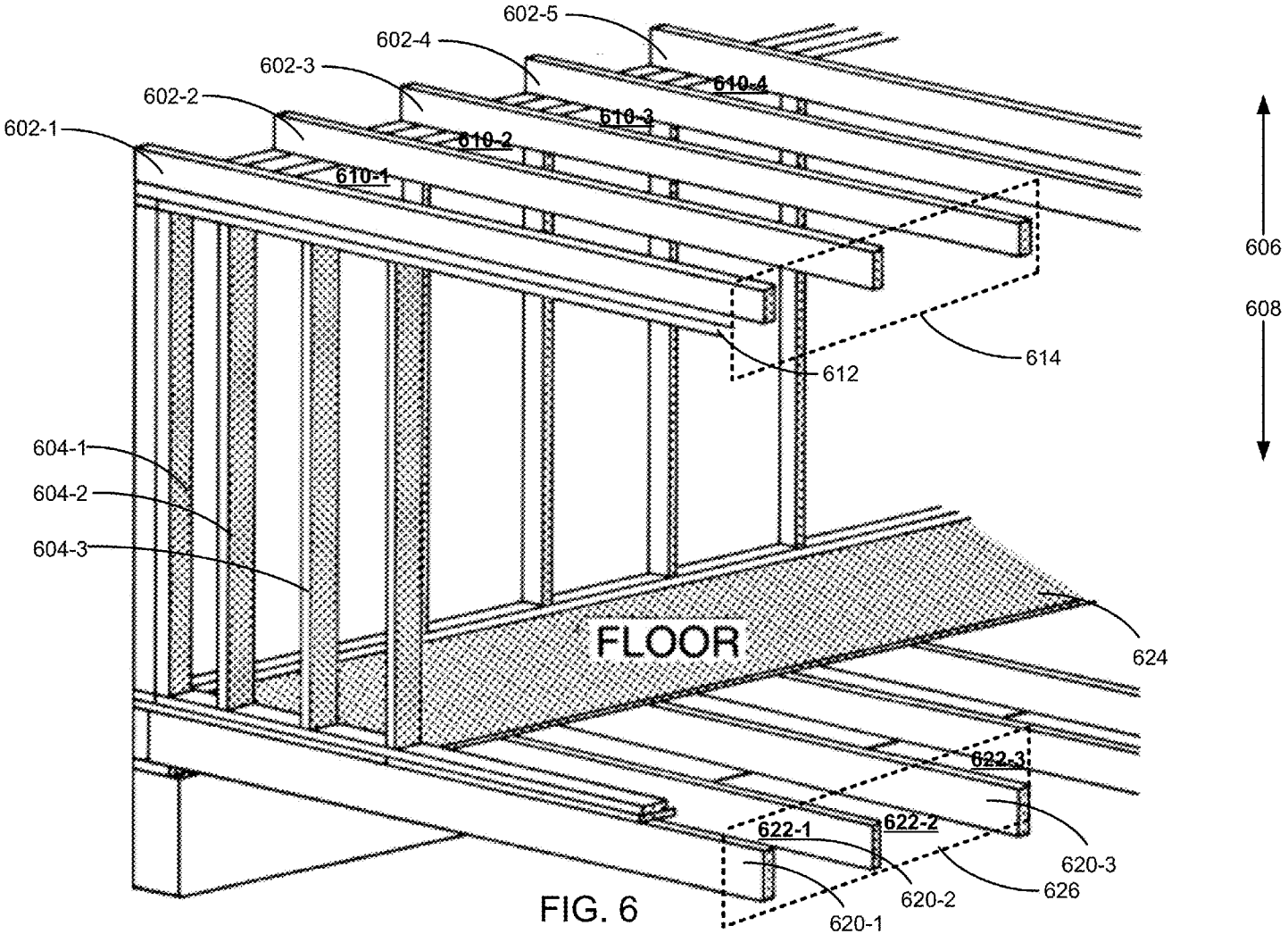
FIG. 6 illustrates various regions that the disclosed framing system can be installed in according to some embodiments.
Figure 7:
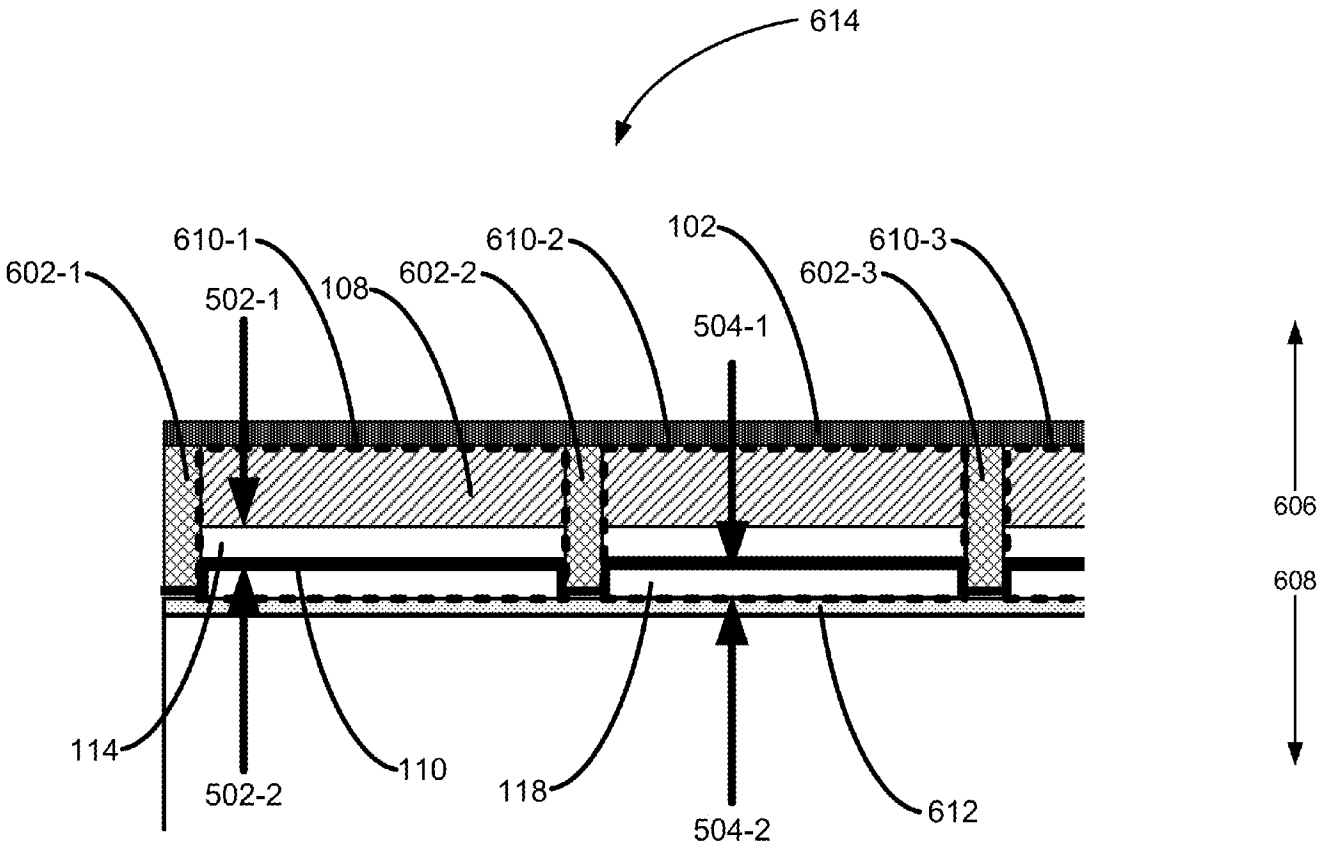
FIG. 7 illustrates first cutaway view of FIG. 6 according to some embodiments in which the disclosed framing system is installed in ceiling joists.

6) having an emissivity of 0.50 or less is attached to the second side of each respective structural frame element 602 in the plurality of structural frame elements. The radiant barrier includes a plurality of indented portions, where each indented portion in the plurality of indented portions is indented into a corresponding structural frame element cavity in the plurality of structural frame element cavities, thereby creating a respective first sealed air space, in a first plurality of sealed air spaces, between the corresponding two-part closed cell spray polyurethane foam and the radiant barrier in each structural frame element cavity in the plurality of structural frame element cavities. An interior panel (ceiling 612 in FIG. 6) covers the radiant barrier and is attached to the second side of each structural frame element in the plurality of structural frame elements thereby creating a respective second sealed space, in a second plurality of sealed air spaces, between the radiant barrier and the interior siding in each structural frame element cavity in the plurality of structural frame element cavities. In this regard, FIG. 7 illustrates a cutaway of region 614 of FIG. 6 in which the exterior siding 102, radiant barrier 110, and foam 108 missing in FIG. 6 are illustrated. That is, FIG. 7 provides a cutaway view of region 614 of FIG. 6 in which the foam 108, structural frame elements 602, interior siding 612, and exterior siding 102 have been respectively hashed and the structural frame element cavities 610 have been delineated with dashed boxes for clarity.

Figure 8:
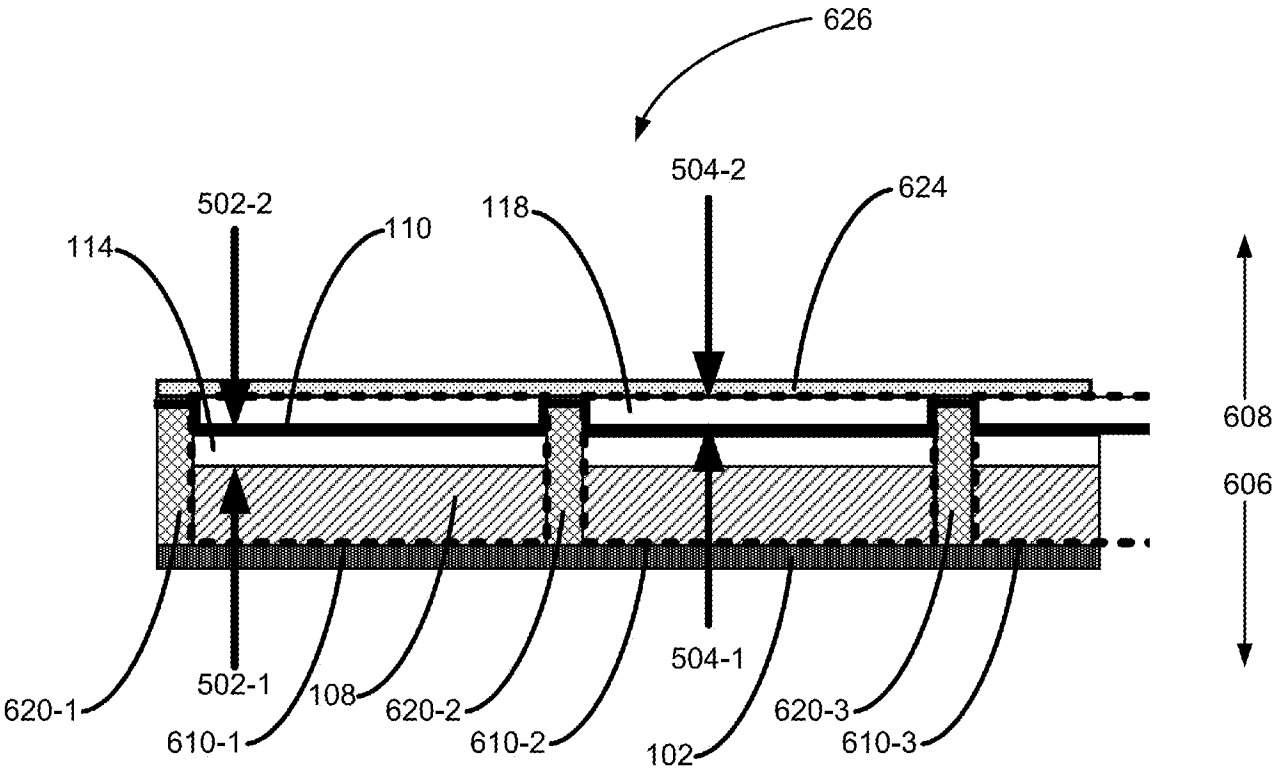
FIG. 8 illustrates second cutaway view of FIG. 6 according to some embodiments in which the disclosed framing system is installed in floor joists.

Moreover, in FIG. 6, in the case where the framing system is part of the flooring, the exterior siding having a first side facing the interior space and an opposing second side facing away from the interior space is also not shown but would rest below joists 620. Thus, the plurality of structural frame elements, where the structural frame elements in the plurality of structural frame elements are arranged in parallel to each other are the joists 620, with each respective structural frame element in the plurality of structural frame elements comprising a first side (facing in direction 608) and an opposing second side (facing in direction 606). The first side of each respective structural frame element in the plurality of structural frame elements abuts the first side of the exterior siding (not shown in FIG. 6). Each respective structural frame element in the plurality of structural frame elements is spaced along the exterior siding at a common interval thereby creating a plurality of structural frame element cavities 622. Each respective structural frame element cavity 622 comprises a polyurethane foam overlaying a portion of the first side of the exterior siding bounded by the respective structural frame element cavity (not shown in FIG. 6). A radiant barrier (not shown in FIG. 6) having an emissivity of 0.50 or less is attached to the second side of each respective structural frame element 622 in the plurality of structural frame elements. The radiant barrier includes a plurality of indented portions, where each indented portion in the plurality of indented portions is indented into a corresponding structural frame element cavity in the plurality of structural frame element cavities, thereby creating a respective first sealed air space, in a first plurality of sealed air spaces, between the corresponding two-part closed cell spray polyurethane foam and the radiant barrier in each structural frame element cavity in the plurality of structural frame element cavities. An interior panel (flooring 624 in FIG. 6) covers the radiant barrier and is attached to the second side of each structural frame element in the plurality of structural frame elements thereby creating a respective second sealed space, in a second plurality of sealed air spaces, between the radiant barrier and the interior siding in each structural frame element cavity in the plurality of structural frame element cavities. In this regard, FIG. 8 illustrates a cutaway of region 626 of FIG. 6 in which the exterior siding 102, radiant barrier 110, and foam 108 missing in FIG. 6 are illustrated. That is, FIG. 8 provides a cutaway view of region 626 of FIG. 6 in which the foam 108, structural frame elements 602, interior siding 612, and exterior siding 102 have been respectively hashed and the structural frame element cavities 622 have been delineated with dashed boxes for clarity.

Moreover, the framing system can be installed using rafters, rather than studs or joists. In such instances, each structural frame element cavity is formed between adjacent rafters and the exterior siding 102 supports the roof.

Figure 9:
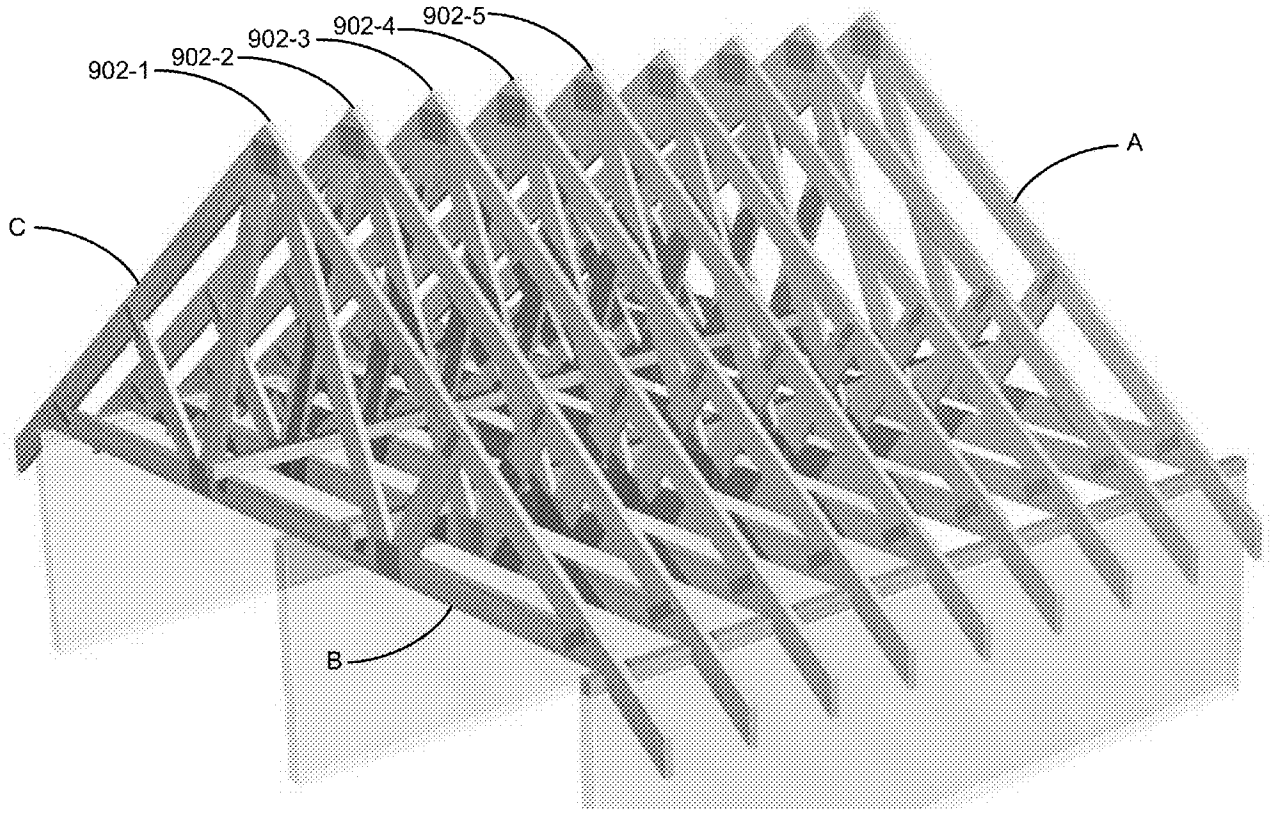
FIG. 9 illustrates proposed portions of conventional joists that can be adapted to include the framing system of the present disclosure.
Figure 10:
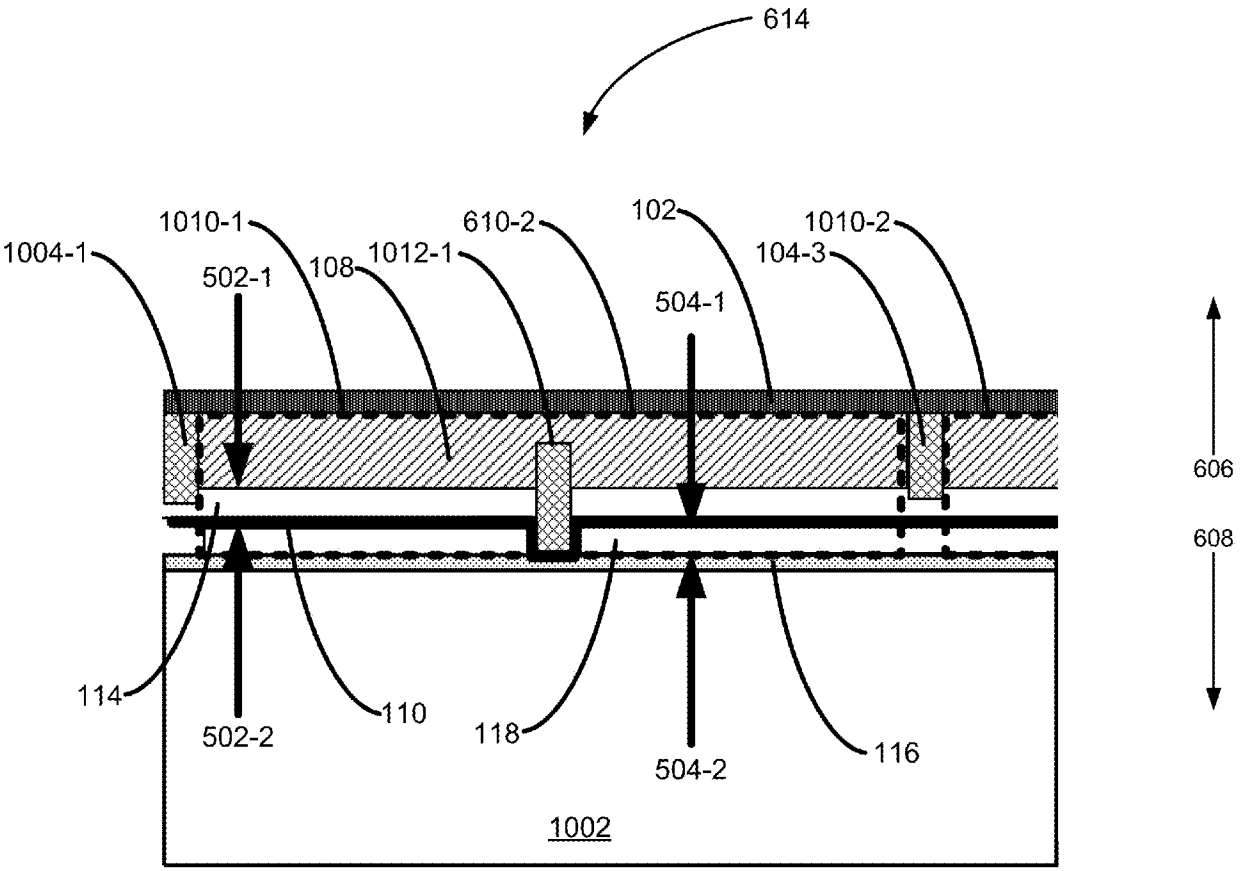
FIG. 10 illustrates the disclosed framing system installed in a double wall system according to some embodiments.

Moreover, in still other embodiments, the framing system can be installed using the trusses in an attic, where each respective structural element in the plurality of structural element is a component of a truss in a corresponding plurality of trusses. Trusses are manufactured systems that are engineered from component wood members connected by flat metal plates with teeth that are pressed into the wood. A "web" structure of triangles is created which balances tension and compression in the component members and can span significant distances. In some instances, trusses are built at the job site using plywood and nails instead of the metal plates. More typically, trusses are built in factories according to the design and specifications prepared by licensed engineers. The variety of truss designs is substantial, both in the 'web' design and the styles of roofs that can be created. FIG. 9, illustrates an exemplary plurality of trusses 902. Referring to FIG. 9, the disclosed framing system can be installed on portions A or C of the trusses and thus, in this regard, would be similar to the use of the disclosed framing system using rafters discussed above. Further referring to FIG. 9, the disclosed framing system can be installed on portion B and thus, in this regard, would be similar to the use of the disclosed framing system using joists discussed above with reference to FIG. 7. Referring to FIG. 10, which is a top view of a double wall system, the disclosed framing system can also be used in double wall systems where the structural frame elements 104 do not traverse all the way from the exterior wall to the interior siding 116. Thus referring to FIG. 10, a framing system abutting an interior space of a building is disclosed. The framing system comprises an exterior siding 102 having a first side facing the interior space 1002 and an opposing second side facing away from the interior space 1002. The framing system further comprises a first plurality of structural frame elements 1004 (of which 1004-1 and 1004-2 are illustrated in FIG. 10). The structural frame elements 1004 in the first plurality of structural frame elements are arranged in parallel to each other. Each respective structural frame element 1004 in the first plurality of structural frame elements comprises a first side. The first side of each respective structural frame element 1004 in the first plurality of structural frame elements abuts the first side of the exterior siding. Each respective structural frame element in the first plurality of structural frame elements is spaced along the exterior siding at a common interval thereby creating a plurality of structural frame element cavities 1010. Each respective structural frame element cavity 1010 comprises a polyurethane foam 108 overlaying a portion of the first side of the exterior siding 102 bounded by the respective structural frame element cavity 1010. The framing system further comprises a second plurality of structural frame elements (of which a single element 1012 is shown in FIG. 10). The structural frame elements 1012 in the second plurality of structural frame elements are arranged in parallel to each other and are interspersed among and parallel to the first plurality of structural frame elements 1004. Each respective structural frame element in the second plurality of structural frame elements comprises a first side and an opposing second side. A radiant barrier 110 having an emissivity of 0.50 or less attached to the second side of each respective structural frame element in the second plurality of structural frame elements. The radiant barrier includes a plurality of indented portions. Each indented portion in the plurality of indented portions is indented into a corresponding structural frame element cavity 1010 in the plurality of structural frame element cavities, thereby creating a respective first sealed air space 114, in a first plurality of sealed air spaces, between the corresponding two-part closed cell spray polyurethane foam and the radiant barrier 110 in each structural frame element cavity 1010 in the second plurality of structural frame element cavities. The framing system further comprises an interior siding 116 covering the radiant barrier 110 and attached to the second side of each structural frame element 1012 in the second plurality of structural frame elements thereby creating a respective second sealed space 118, in a second plurality of sealed air spaces, between the radiant barrier 110 and the interior siding 116 in each structural frame element cavity 1010 in the plurality of structural frame element cavities.

The terminology used in the present disclosure is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

REFERENCES CITED AND ALTERNATIVE EMBODIMENTS

All references cited herein are incorporated herein by reference in their entirety and for all purposes to the same extent as if each individual publication or patent or patent application was specifically and individually indicated to be incorporated by reference in its entirety for all purposes.

Many modifications and variations of this invention can be made without departing from its spirit and scope, as will be apparent to those skilled in the art. The specific embodiments described herein are offered by way of example only. The embodiments were chosen and described in order to best explain the principles of the invention and its practical applications, to thereby enable others skilled in the art to best utilize the invention and various embodiments with various modifications as are suited to the particular use contemplated. The invention is to be limited only by the terms of the appended claims, along with the full scope of equivalents to which such claims are entitled.

What is claimed is:

1. A framing system abutting an interior space of a building, the framing system comprising:

an exterior siding having a first side facing the interior space and an opposing second side facing away from the interior space;

a plurality of structural frame elements, wherein the structural frame elements in the plurality of structural frame elements are arranged in parallel to each other, each respective structural frame element in the plurality of structural frame elements comprising a first side and an opposing second side, wherein the first side of each respective structural frame element in the plurality of structural frame elements abuts the first side of the exterior siding, each respective structural frame element in the plurality of structural frame elements is spaced along the exterior siding at a common interval thereby creating a plurality of structural frame element cavities, and each respective structural frame element cavity comprises a polyurethane foam overlaying a portion of the first side of the exterior siding bounded by the respective structural frame element cavity;

a radiant barrier having an emissivity of 0.50 or less is attached to the second side of each respective structural frame element in the plurality of structural frame elements, the radiant barrier including a plurality of indented portions, wherein each indented portion in the plurality of indented portions is indented into a corresponding structural frame element cavity in the plurality of structural frame element cavities, thereby creating a respective first sealed air space, in a first plurality of sealed air spaces, between the corresponding polyurethane foam and the radiant barrier in each structural frame element cavity in the plurality of structural frame element cavities; and an interior siding covering the radiant barrier and attached to the second side of each structural frame element in the plurality of structural frame elements thereby creating a respective second sealed space, in a second plurality of sealed air spaces, between the radiant barrier and the interior siding in each structural frame element cavity in the plurality of structural frame element cavities.

2. The framing system of claim 1, wherein the polyurethane foam overlaying the portion of the second side of the exterior siding bounded by a structural frame element cavity in the plurality of structural frame element cavities is a medium-density two-part closed-cell polyurethane foam insulation having a thickness of at least 38 millimeters (1.5 inches) and a long term thermal resistance (LTTR) R-value between 6.9 and 7.0 per inch.

3. The framing system of claim 1, wherein the polyurethane foam overlaying the portion of the first side of the exterior siding bounded by a structural frame element cavity in the plurality of structural frame element cavities is a medium-density two-part closed-cell polyurethane foam insulation having a thickness of at least 45 millimeters and a long term thermal resistance (LTTR) R-value between 5.1 and 6.8 per inch.

4. The framing system of claim 1, wherein the exterior siding comprises one or more wood panels, the interior siding comprises one or more sheetrock panels, and each respective structural frame element in the plurality of structural frame elements is a stud having a two-inch by four-inch cross section, is made of wood, and is at least a foot long.

5. The framing system of claim 1 wherein the radiant barrier is stapled along a third side of a first structural frame element and a fourth side of a second structural frame element, the second structural frame element adjacent to the first structural frame element in the plurality of structural frame elements, thereby forming a first indented portion, in the plurality of indented portions, between the first structural frame element and the second structural frame element, and the second sealed air space in the second plurality of sealed air spaces in the first indented portion has a width that is determined by an air spacing between the radiant barrier within the first indented portion and the interior siding.

6. The framing system of claim 5, wherein the air spacing is between 0.5 inches and 1.5 inches.

7. The framing system of claim 1, wherein a width of each respective first sealed air space between the corresponding polyurethane foam and the radiant barrier in each structural frame element cavity in the plurality of structural frame element cavities is between 0.5 inches and 1.5 inches, and a width of each respective second sealed air space in the second plurality of sealed air spaces between the radiant barrier in each structural frame element cavity in the plurality of structural frame element cavities and the interior siding is between 0.5 inches and 1.5 inches.

8. The framing system of claim 1, wherein the framing system has a wood frame wall R-value of 13 or greater without accounting for the first plurality of sealed air spaces or the second plurality of sealed air spaces.

9. The framing system of claim 1, wherein the framing system has a wood frame wall R-value of 16 or greater without accounting for the first plurality of sealed air spaces or the second plurality of sealed air spaces.

10. The framing system of claim 1, wherein the framing system has a wood frame wall R-value of 20 or greater without accounting for the first plurality of sealed air spaces or the second plurality of sealed air spaces.

11. The framing system of claim 1, wherein the radiant barrier comprises aluminum or copper infused in a polymeric web.

12. The framing system of claim 11, wherein the polymeric web is a polyester, polypropylene, or polyethylene film.

13. The framing system of claim 1, wherein the radiant barrier has an emissivity of less than 0.08.

14. The framing system of claim 1, wherein the radiant barrier has an emissivity of less than 0.06.

15. The framing system of claim 1, wherein a thickness of the polyurethane foam overlaying the portion of the first side of the exterior siding is at least 0.5 inches thick and provides an R-value of at least 5.

16. The framing system of claim 1, wherein a thickness of the polyurethane foam overlaying the portion of the first side of the exterior siding is at least 0.8 inches thick and provides an R-value of at least 6.

17. The framing system of claim 1, wherein the interior siding comprises a sheet rock panel having a thickness of ½-inch (13 mm), ⅝-inch (16 mm), ¼-inch (6.4 mm), ⅜-inch (9.5 mm), ¾-inch (19.0 mm) or 1-inch (25.4 mm).

18. The framing system of claim 1, wherein the interior siding comprises a sheet rock panel having an R-value of less than 0.6.

19. The framing system of claim 1, wherein the interior siding comprises a sheet rock panel having an R-value of less than 0.6, the exterior siding comprises wood siding or plywood having an R-value of less than 1.0, and the framing system has a wood frame wall R-value of 13 or greater without accounting for the first plurality of sealed air spaces or the second plurality of sealed air spaces.

20. The framing system of claim 1, wherein the interior siding comprises a sheet rock panel having an R-value of less than 0.6, the exterior siding comprises wood siding or plywood having an R-value of less than 1.0, and the framing system has a wood frame wall R-value of 16 or greater without accounting for the first plurality of sealed air spaces or the second plurality of sealed air spaces.

21. The framing system of claim 1, wherein the second side of the exterior siding is at least 100 square feet.

22. The framing system of claim 1, wherein the exterior siding comprises Nail Base or plywood sheathing.

23. The framing system of claim 1, wherein an exterior insulation is overlaid on the second side of the exterior siding.

24. The framing system of claim 1, wherein the exterior siding comprises plywood sheathing, a trowel applied adhesive layer and liquid applied air/water resistive barrier are overlaid on the second side of the exterior siding, an exterior insulation is overlaid on the trowel applied adhesive layer, a base coat stucco with reinforcing wire mesh is overlaid the exterior insulation, and an acrylic-based finish coat is overlaid on the base coat stucco.

25. The framing system of claim 1, wherein the radiant barrier comprises a plastic mesh that is treated with aluminum or copper, the radiant barrier comprises a first face and a second face, and the first face and the second face are overlaid with a protective barrier.

26. The framing system of claim 1, wherein the radiant barrier is non-laminated.

27. The framing system of claim 1, wherein each respective structural element in the plurality of structural element is a joist.

28. The framing system of claim 1, wherein each respective structural element in the plurality of structural element is a rafter.

29. The framing system of claim 1, wherein each respective structural element in the plurality of structural element is a component of a truss in a corresponding plurality of trusses.

30. A framing system abutting an interior space of a building, the framing system comprising:

an exterior siding having a first side facing the interior space and an opposing second side facing away from the interior space;

a first plurality of structural frame elements, wherein the structural frame elements in the first plurality of structural frame elements are arranged in parallel to each other, each respective structural frame element in the first plurality of structural frame elements comprising a first side, wherein the first side of each respective structural frame element in the first plurality of structural frame elements abuts the first side of the exterior siding, each respective structural frame element in the first plurality of structural frame elements is spaced along the exterior siding at a common interval thereby creating a plurality of structural frame element cavities, and each respective structural frame element cavity comprises a polyurethane foam overlaying a portion of the first side of the exterior siding bounded by the respective structural frame element cavity;

a second plurality of structural frame elements, wherein the structural frame elements in the second plurality of structural frame elements are arranged in parallel to each other and are interspersed among and parallel to the first plurality of structural frame elements, each respective structural frame element in the second plurality of structural frame elements comprising a first side and an opposing second side, wherein a radiant barrier having an emissivity of 0.50 or less attached to the second side of each respective structural frame element in the second plurality of structural frame elements, the radiant barrier including a plurality of indented portions, wherein each indented portion in the plurality of indented portions is indented into a corresponding structural frame element cavity in the plurality of structural frame element cavities, thereby creating a respective first sealed air space, in a first plurality of sealed air spaces, between the corresponding two-part closed cell spray polyurethane foam and the radiant barrier in each structural frame element cavity in the second plurality of structural frame element cavities; and an interior siding covering the radiant barrier and attached to the second side of each structural frame element in the second plurality of structural frame elements thereby creating a respective second sealed space, in a second plurality of sealed air spaces, between the radiant barrier and the interior siding in each structural frame element cavity in the plurality of structural frame element cavities.

* * * * *